US007988208B2

(12) United States Patent
Zugaza Fernandez

(10) Patent No.: US 7,988,208 B2
(45) Date of Patent: Aug. 2, 2011

(54) SYSTEM FOR LOCKING DOORS ON GOODS BOXES

(75) Inventor: Juan Manuel Zugaza Fernandez, Zuasti (ES)

(73) Assignee: Mecadetol, S.A., Imarcoain (Navarra) (ES)

( * ) Notice: Subject to any disclaimer, the term of this patent is extended or adjusted under 35 U.S.C. 154(b) by 1028 days.

(21) Appl. No.: 11/168,537

(22) Filed: Jun. 29, 2005

(65) Prior Publication Data

US 2006/0001271 A1 Jan. 5, 2006

(30) Foreign Application Priority Data

Jul. 1, 2004 (ES) ..... 200401590

(51) Int. Cl.
*E05C 19/18* (2006.01)
*B65D 45/00* (2006.01)

(52) U.S. Cl. ..... 292/288; 292/256; 292/256.65; 292/256.69; 292/DIG. 49

(58) Field of Classification Search ..... 292/288, 292/246, 247, 249, 256, 256.6, 256.65, 256.69, 292/258, DIG. 31, DIG. 37, DIG. 49
See application file for complete search history.

(56) References Cited

U.S. PATENT DOCUMENTS

| | | | | | |
|---|---|---|---|---|---|
| 2,832,446 | A | * | 4/1958 | Smith et al. | 403/321 |
| 3,891,254 | A | * | 6/1975 | Lile | 292/113 |
| 4,678,216 | A | * | 7/1987 | Gregory | 292/256.69 |
| 4,858,970 | A | * | 8/1989 | Tedesco et al. | 292/113 |
| 5,129,537 | A | * | 7/1992 | Bordner et al. | 220/321 |
| 5,295,604 | A | * | 3/1994 | Van Ryswyk | 220/321 |
| 6,007,120 | A | * | 12/1999 | Vogt et al. | 292/256.69 |
| 6,036,238 | A | * | 3/2000 | Lallament | 292/100 |

FOREIGN PATENT DOCUMENTS

| | | | |
|---|---|---|---|
| GB | EP 618374 | * | 2/1994 |
| IT | EP 226552 | * | 6/1987 |

* cited by examiner

*Primary Examiner* — Carlos Lugo
(74) *Attorney, Agent, or Firm* — The Nath Law Group; Jerald Meyer; Matthew Moffa

(57) ABSTRACT

System for locking doors on goods boxes, involving a mechanism that consists of an operating lever (4), to which attachment is made of a set of knuckle-jointed connecting rods (7 and 8) pivoting like a compass, forming a four-sided articulated arrangement that is operated by use of the lever (4) in order to lock and release the respective head arrangements (10 and 12) with regard their corresponding lock attachment housings (11 and 13).

15 Claims, 5 Drawing Sheets

SYSTEM FOR LOCKING DOORS ON GOODS BOXES

TECHNICAL FIELD

The present invention involves the application of bolt-action locking devices on the doors of goods boxes on lorries, goods vans or containers, proposing a locking system that provides advantageous features in the design structure and in the use of said devices.

PRIOR ART

The use is widespread of double-leaf doors on the rear of the goods box on vehicles, such as lorries, goods vans or containers, with these doors employing a bolt-action type locking system, consisting of a bar whose ends are fitted with locking features, an upper one for straightforward coupling and a lower one that is fitted with the means of operation.

This lower locking device with the means of operation consists of a lever and a fixed attachment housing, whose assembly constitutes a device for operating and locking the corresponding bolt.

The lever consists of an arm held by an articulated device, with said arm fitted with a coupling head that can be inserted into a housing designed for said purpose in a fixed attachment housing.

The locking system on the two component leaves of a door consists of two bolts such as those mentioned on each leaf, whereby in order to avoid possible interferences between the corresponding levers, the two bolts fitted on each leaf need to be placed at a sufficient distance away from each other, thereby conditioning the assembly and effectiveness of the locking.

PURPOSE OF THE INVENTION

In accordance with the present invention, a locking system is proposed for the aforementioned doors on the goods boxes on lorries or containers, which has been designed as per certain manufacturing specifications that provide an advantageous system of operation.

This system covered by the invention consists of an operating mechanism that provides simultaneous locking regarding two coupling points, having a lever that pivots at one attachment point and which is joined to a set of two knuckle-jointed connecting rods in the form of a compass, forming an articulated four-sided arrangement in which one of the sides is the lever, a further two sides are formed by the compass-shaped knuckle-shaped connecting rods and the fourth side is the leaf of the door in question, whilst at the end of the pivotal attachment of the lever and at the end of the articulated knuckle-jointed connecting rod on the corresponding leaf of the door, two heads stand out respectively, which can be fitted into their respective coupling housings for locking.

This provides a system whereby a single bolt on each leaf of the doors in question caters for the closure of the same, with locking regarding numerous holding points, avoiding any problem of interference involving the operating levers on the locking mechanism.

The housings for effecting the locking consist of fixed elements that are mounted onto the chassis of the goods box in question, with use foreseen of simple devices, in which arrangement is made of the housings for effecting the locking on points that are distant from the middle area where the leaves of the door meet, whereas said middle area is fitted with a device that provides two locking housings for holding both locking mechanisms on the two leaves of the door.

This provides an arrangement that facilitates the assembly mounting of the lock, providing ideal conditions of safety for the corresponding mechanisms in the locking attachment, with considerable ease of operation.

The locking system covered by the invention therefore features truly advantageous features, with a design of its own and of a preferential nature regarding standard solutions for locking systems for the same application.

DETAILED DESCRIPTION OF THE INVENTION

The purpose of the present invention refers to a locking system for the rear doors on goods boxes on vehicles such as lorries, goods vans and containers, proposing a design for said locking that provides an advantageous system of operation.

Figure 1:
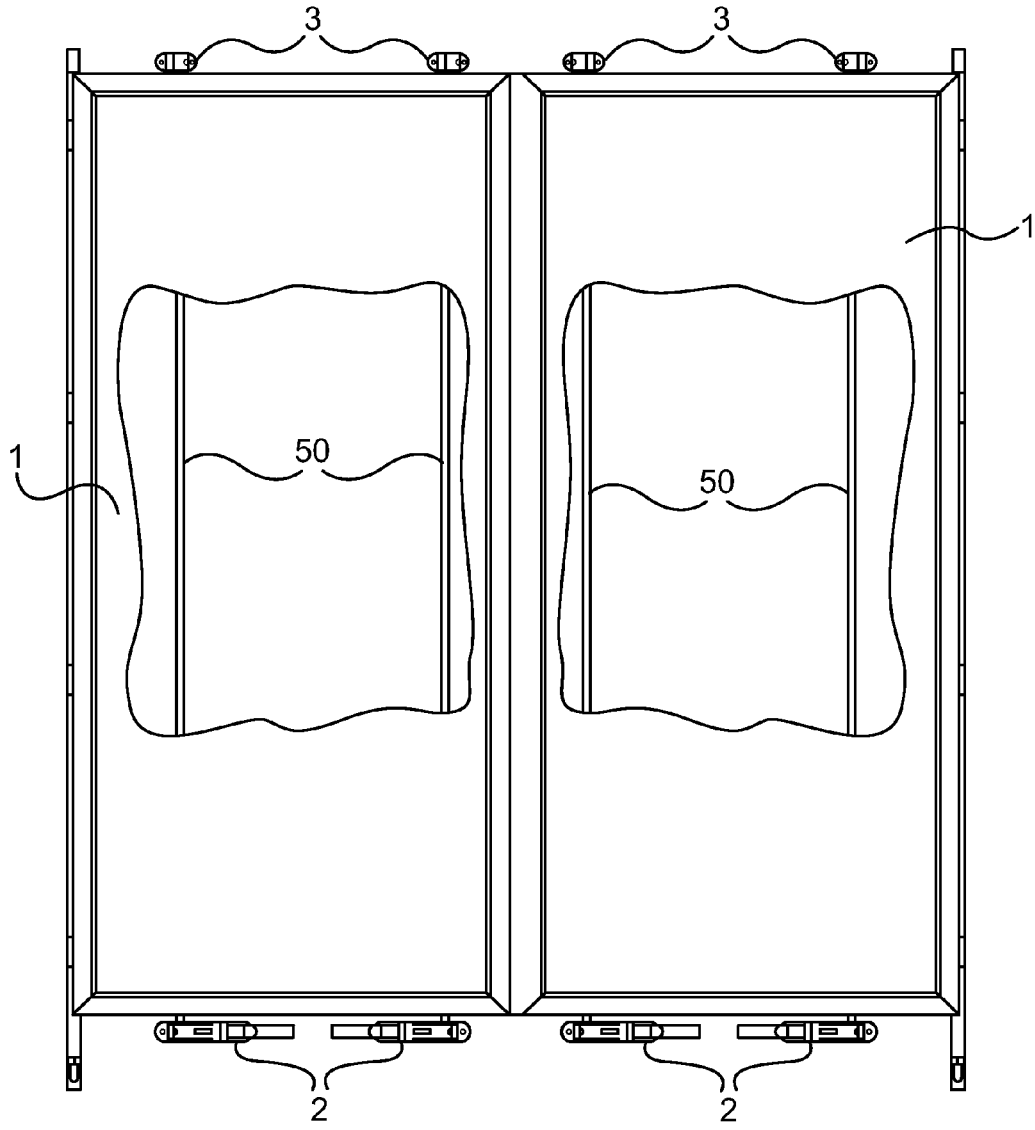
FIG. 1 shows a front view of a set of doors on a goods box with a standard locking system.

Standard systems for these types of locks consist of two bolt-action locking devices on each one of the leaves (1) on the doors in question, as shown in FIG. 1, with said devices having their respective operating mechanisms (2) for the individual operation of each one of them, providing for a locking arrangement (3) on the upper part that is operated by a bar (50) by means of the corresponding operating mechanism (2) fitted on the lower part, whilst the actual operating mechanism (2) establishes another attachment housing on the lower part.

The system of the invention likewise involves bolt-action locking devices, which involve operating mechanisms that in themselves constitute two attachment housings on the lower part of the lock, whereby only one device is required for each leaf (1) on the doors in question to provide locking with the same degree of effectiveness as with the two devices in the standard system.

The mechanism of the invention consists of an operating lever (4), which is applied with a pivotal attachment (5) at one end, regarding the leaf of the door (1) in question, whereas in the middle part of said lever (4) pivotal attachment is made (6) of a set of two knuckle-jointed connecting rods (7 and 8) which form a compass-shaped arrangement, whose assembly in turn involves pivotal attachment (9) at the other end on the leaf of the door (1), as shown in FIGS. 2 to 5.

With this design, the mechanism forms an articulated four-sided arrangement in which one of the sides is the corresponding lever (4), a further two sides consist of the knuckle-jointed connecting rods (7 and 8) and the fourth side is the leaf of the corresponding door (1).

At the end at which the pivotal attachment is made (5), the lever (4) has a projecting head (10), which can be fitted into an attachment housing (11) to provide the locking; whereas the knuckle-jointed connecting rod (8), which caters for the pivotal attachment (9) on the chassis, has in turn a projecting head (12) at one end, which can likewise fit into its respective attachment housing (13) to provide the locking.

The attachment housings (11 and 13) for locking are designed as respective items (14 and 15) that are mounted onto the chassis of the goods box, whereby certain items (15) are designed to be attached in a position distant from the central joining area of the leaves (1) of the door in question, with these items (15) being single ones, that is, they cater for a single housing (13) for fastening the lock, whereas in the central joining area of the leaves (1) there is a twin item (14), that is, it caters for two housings (11) for fastening the lock, being designed for the coupling of the mechanisms of both leaves (1) of the door.

Figure 2:
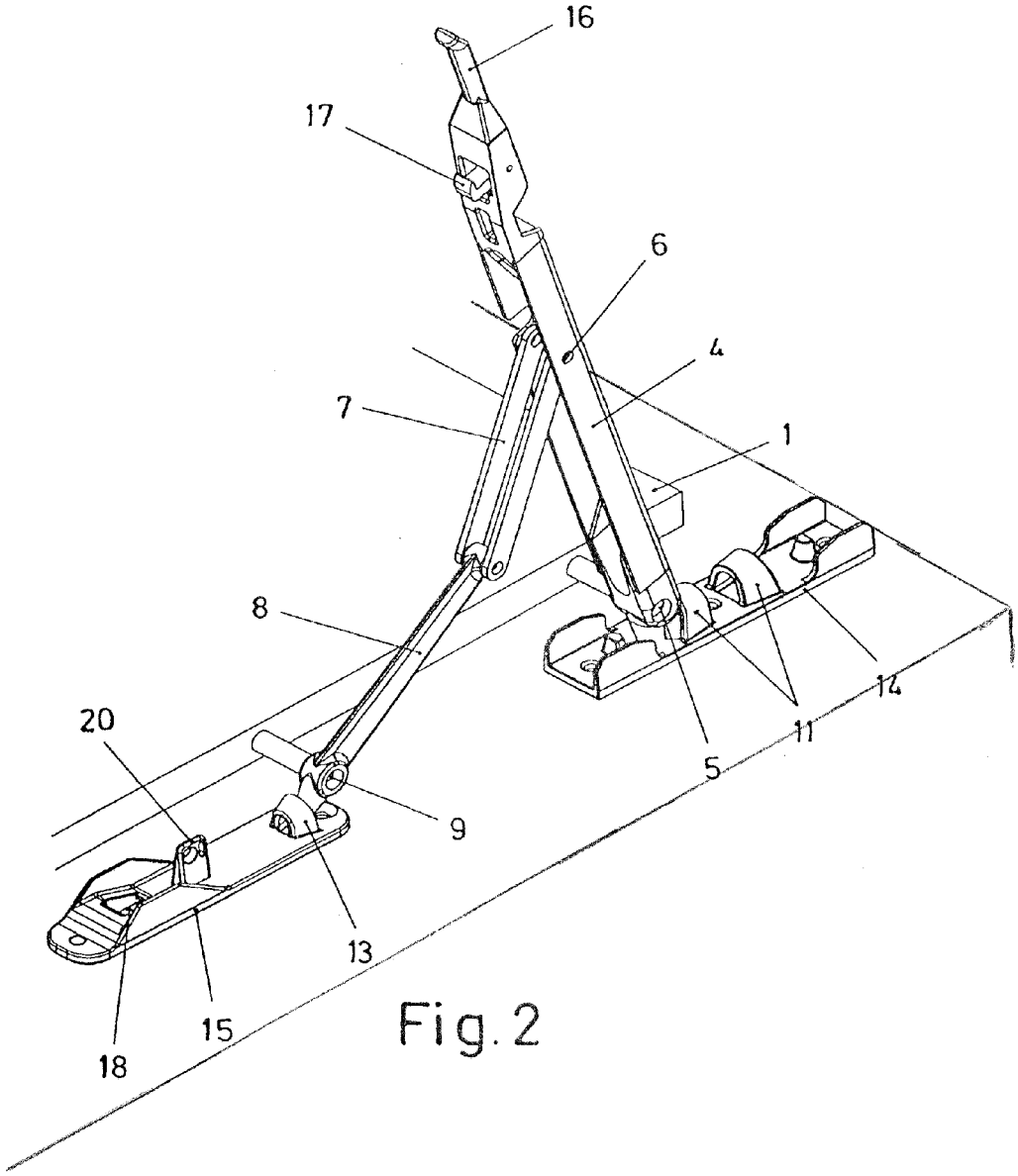
FIG. 2 is a view of a locking mechanism as per the system of the invention, in the open position.
Figure 3:
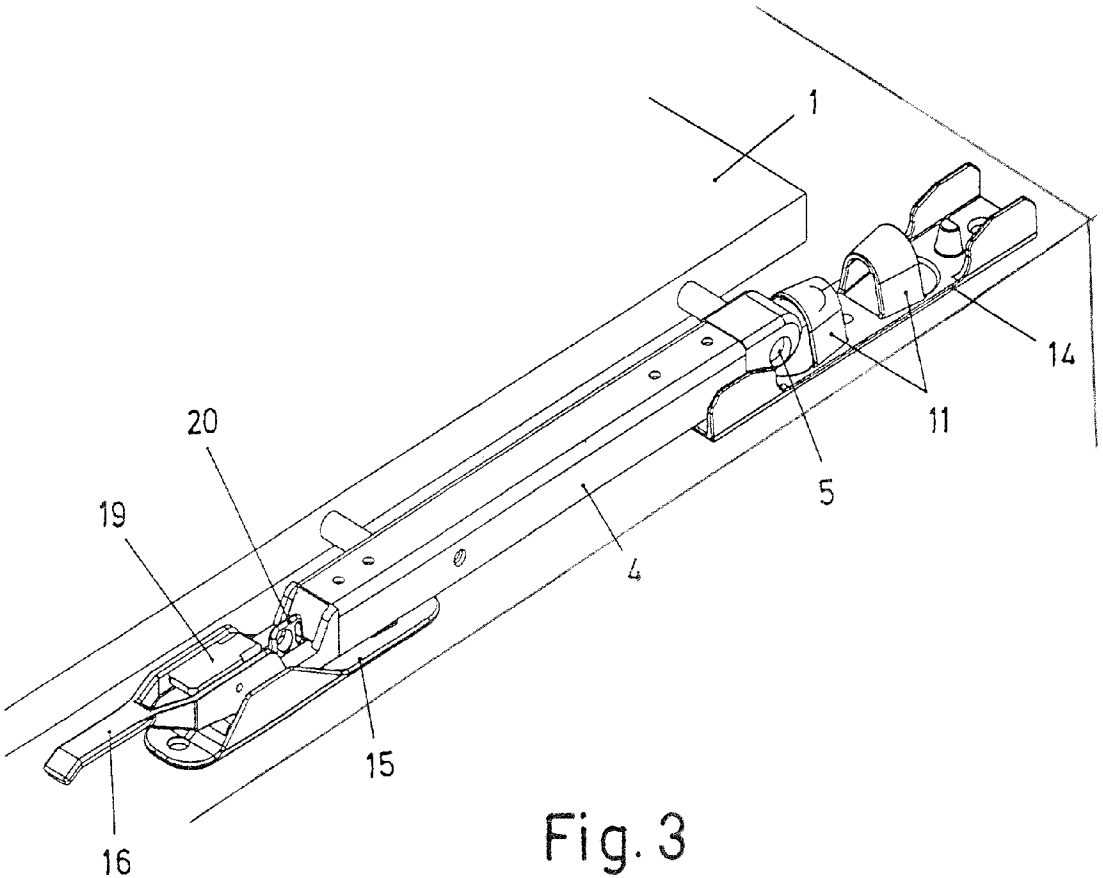
FIG. 3 is a view of the same locking mechanism as before, in the closed position.
Figure 4:
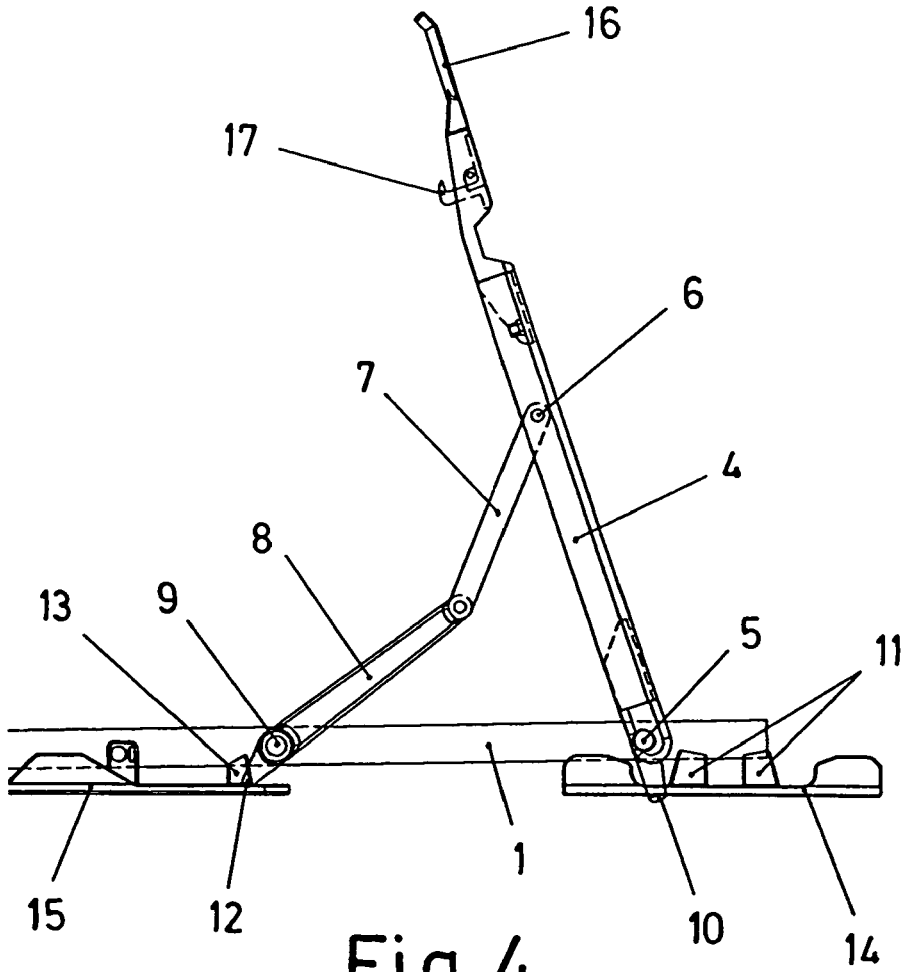
FIGS. 4 and 5 are the respective side views of the locking mechanism in an initial position and in an intermediate position in the locking operation.
Figure 5:
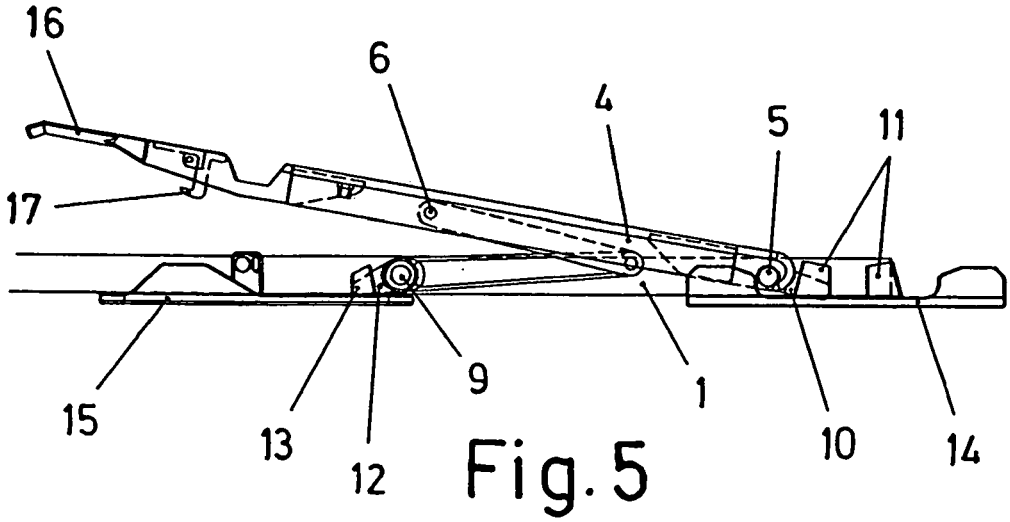
Figure 6:
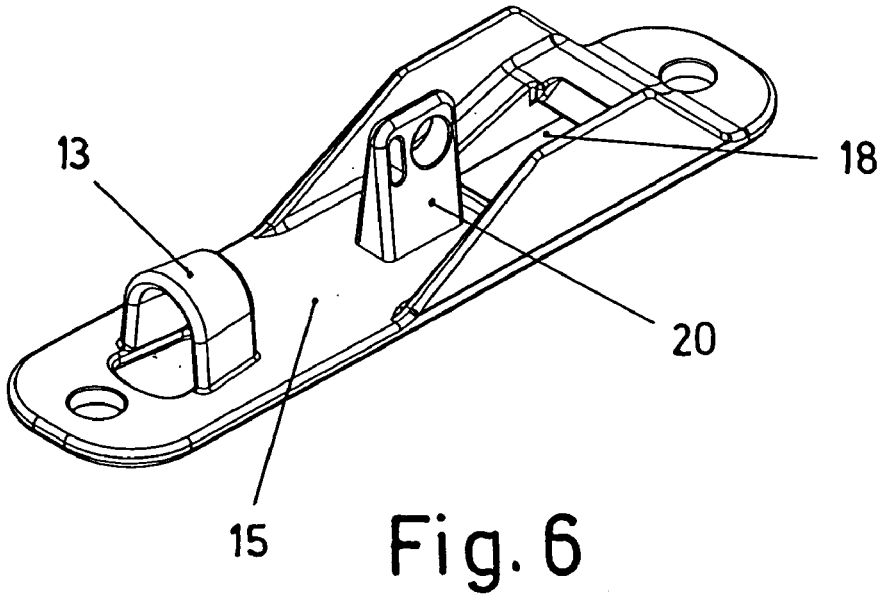
FIG. 6 is a view of a single device for the fastening housing for the lock.
Figure 7:
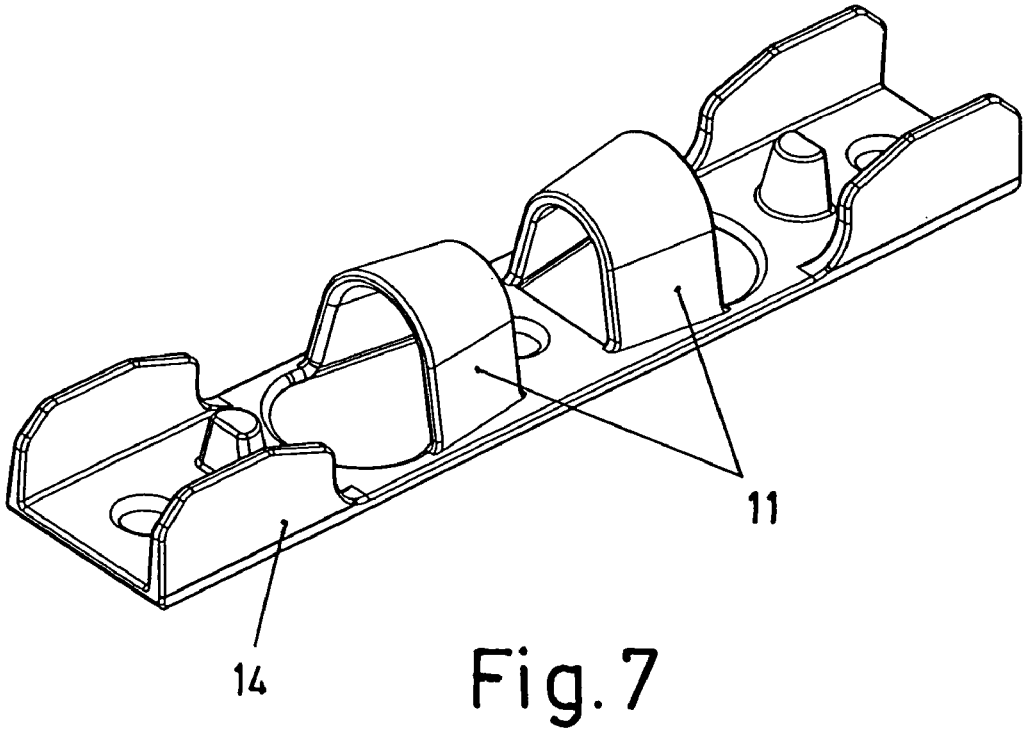
FIG. 7 is a view of a twin device for the fastening housing for the lock.

In this way, when the locking mechanism is in the open position, the head arrangements (10 and 12) are free from their corresponding housings (11 and 13), which means that the leaf (1) on that side of the door can be opened. When closing the door (1) with the corresponding locking mechanism in the open position, the corresponding head arrangements (10 and 12) are in line with the corresponding attachment housings (11 and 13) as shown in FIG. 2, so that by operating the lever (4) the head arrangements (10 and 12) lock into the corresponding housings (11 and 13), as shown in FIGS. 4 and 5, with the fastening of the lock ensured when the lever (4) is pushed into its flat position, as shown in FIG. 3.

The free end of the lever (4) has a handle-like arrangement (16) to make operation easier, furthermore incorporating a catch (17), which can be fitted into a slot (18) on the corresponding single item attachment housing (15), thereby ensuring the mechanism stays closed, being fitted with a button (19) for releasing the catch (17) on the housing prior to opening. The attachment housing (15) has a raised lug (20), which in the closed position passes through the lever (4), allowing for the lock to be safeguarded by a padlock or similar device.

The invention claimed is:

1. System for locking doors on goods boxes, of the kind that consists of mechanisms operated by means of attachment housings for locking on the lower part of door leaves (1), the system comprising:

an operating mechanism including a lever (4);

a first pivotal attachment (5) incorporated in the lever, and attachable at one end on the leaf of a corresponding door (1);

a second pivotal attachment (6) provided at a middle part of said lever (4);

a first connecting rod (7) pivotably attached at a first end to the second pivotal attachment;

a second connecting rod (8) attached at a first end thereof to the first connecting rod at a second end of the first connecting rod, the first and second connecting rods forming a knuckle-jointed connection (7 and 8);

a third pivotal attachment (9) attachable to one of the door leafs (1), and extending away from a plane of the door leaf, the second connecting rod (8) connected at a second end thereof to the third pivotal attachment (9);

first and second engagement fitments (14, 15) attachable to the goods box; and first and second head arrangements (10 and 12) engagable with the engagement fitments, the respective head arrangements (10 and 12), matable with corresponding ones of the engagement fitments (11 and 13) for latching to the goods box.

2. System for locking doors on goods boxes, according to claim 1 characterized in that the lever (4) together with the knuckle-jointed connecting rods (7 and 8) form a four-sided articulated arrangement, wherein operation by action of the lever (4) produces the locking and releasing of the head arrangements (10 and 12) regarding their corresponding housings (11 and 13).

3. System for locking doors on goods boxes, according to claim 1 characterized in that placed at a distance from the middle area where the leaves join on the door (1), certain fixed items (15) are mounted that constitute a fastening (13) for the attachment housing of the corresponding locking mechanism, whilst in the middle area where the leaves meet on the door (1) there is a fixed item (14) that provides two attachments (11) for the attachment housings for the locking mechanism.

4. System for locking doors on goods boxes, according to claim 1 characterized in that the lever (4) on the locking mechanism includes a catch position, fitted with a button (19) for the release of said catch.

5. System for locking doors on goods boxes, according to claim 1, further comprising a lug passing into alignment with the operating mechanism in the closed position, for accepting a padlock or similar safeguarding device.

6. System for locking doors on goods boxes, according to claim 1, further comprising:

at least one shaft arrangement (5 or 9) rotably fixed to at least one of the lever (4) and the second connecting rod (8), and extending to a remote part of the door leaf and a remote head arrangement fixably attached to the shaft arrangement and engagable with a remote engagement fitment (3), wherein movement of the operating mechanism causes coordinated locking of the first and second head arrangements and the remote head arrangement with corresponding ones of the engagement fitments.

7. System for locking doors on goods boxes, according to claim 6 characterized in that the lever (4) together with the knuckle-jointed connecting rods (7 and 8) form a four-sided articulated arrangement, wherein operation by action of the lever (4) produces the locking and releasing of the head arrangements (10 and 12) regarding their corresponding housings (11 and 13).

8. System for locking doors on goods boxes, according to claim 6 characterized in that placed at a distance from the middle area where the leaves join on the door (1), certain fixed items (15) are mounted that constitute a fastening (13) for the attachment housing of the corresponding locking mechanism, whilst in the middle area where the leaves meet on the door (1) there is a fixed item (14) that provides two attachments (11) for the attachment housings for the locking mechanism.

9. System for locking doors on goods boxes, according to claim 6 characterized in that the lever (4) on the locking mechanism includes a catch position, fitted with a button (19) for the release of said catch.

10. System for locking doors on goods boxes, according to claim 6, further comprising a lug passing into alignment with the operating mechanism in the closed position, for accepting a padlock or similar safeguarding device.

11. System for locking doors on goods boxes, according to claim 1, further comprising:

a first shaft (5) rotably fixed to the lever (4), and extending to a remote end of the door leaf;

a second shaft (9) rotably fixed to the second connecting rod (8), and extending to the remote part of the door leaf;

a pair of remote engagement fitments (3) attachable to a chassis of the goods box in alignment with the remote part of the door leaf; and a pair of remote head arrangements fixably attached to the first and second shafts and engagable with respective ones of the remote engagement fitments, wherein movement of the operating mechanism causes coordinated locking of the first and second head arrangements and the pair of remote head arrangements with corresponding ones of the engagement fitments.

12. System for locking doors on goods boxes, according to claim 11 characterized in that the lever (4) together with the knuckle-jointed connecting rods (7 and 8) form a four-sided articulated arrangement, wherein operation by action of the lever (4) produces the locking and releasing of the head arrangements (10 and 12) regarding their corresponding housings (11 and 13).

13. System for locking doors on goods boxes, according to claim 11 characterized in that placed at a distance from the middle area where the leaves join on the door (1), certain fixed items (15) are mounted that constitute a fastening (13) for the attachment housing of the corresponding locking mechanism, whilst in the middle area where the leaves meet on the door (1) there is a fixed item (14) that provides two attachments (11) for the attachment housings for the locking mechanism.

14. System for locking doors on goods boxes, according to claim 11 characterized in that the lever (4) on the locking mechanism includes a catch position, fitted with a button (19) for the release of said catch.

15. System for locking doors on goods boxes, according to claim 11, further comprising a lug passing into alignment with the operating mechanism in the closed position, for accepting a padlock or similar safeguarding device.

* * * * *